US010159628B2

(12) United States Patent
Edgerley et al.

(10) Patent No.: US 10,159,628 B2
(45) Date of Patent: Dec. 25, 2018

(54) CLOSURE AND FEEDING BOTTLE INCORPORATING IT

(71) Applicant: FITSON SINGAPORE PTE LTD, Singapore (SG)

(72) Inventors: David Anthony Edgerley, London (GB); Graham Antony Tulett, London (GB); Ching Chan, Singapore (SG)

(73) Assignee: FITSON SINGAPORE PTE LTD (SG)

( * ) Notice: Subject to any disclaimer, the term of this patent is extended or adjusted under 35 U.S.C. 154(b) by 0 days.

(21) Appl. No.: 15/126,896

(22) PCT Filed: Mar. 17, 2014

(86) PCT No.: PCT/SG2014/000133
§ 371 (c)(1),
(2) Date: Sep. 16, 2016

(87) PCT Pub. No.: WO2015/142279
PCT Pub. Date: Sep. 24, 2015

(65) Prior Publication Data

US 2017/0105901 A1 Apr. 20, 2017

(51) Int. Cl.
*A61J 11/04* (2006.01)
*A61J 11/00* (2006.01)
*A61J 9/00* (2006.01)
(Continued)

(52) U.S. Cl.
CPC ..... *A61J 11/008* (2013.01); *A61J 9/00* (2013.01); *A61J 9/085* (2013.01); *A61J 11/04* (2013.01);
(Continued)

(58) Field of Classification Search
CPC ..... A61J 9/085; A61J 11/008; A61J 11/04
(Continued)

(56) References Cited

U.S. PATENT DOCUMENTS 1,587,167 A * 6/1926 Marsden ..... A47J 41/0083 206/518
2,843,281 A * 7/1958 Gallois ..... A61J 9/00 215/11.1
(Continued)

FOREIGN PATENT DOCUMENTS

WO 2005/000700 A1 1/2005
WO 2013/159287 A1 10/2013

OTHER PUBLICATIONS

Search Report and Written Opinion issued for International Patent Application No. PCT/SG2014/000133 dated Jan. 5, 2015 (13 pages).

*Primary Examiner* — Sue A Weaver
(74) *Attorney, Agent, or Firm* — Prince Lobel Tye LLP

(57) ABSTRACT

Closures are provided consisting of a lid or cap member and a container member. These are inter-engageable with one another. The lid or cap member has a skirt and the container member has an upstanding rim, each of which is of generally polygonal (preferably square) shape. Located on each of the facing walls on each side of the polygonal shape are inter-engageable projections. The inter-engaging surfaces of the projections run substantially in a plane perpendicular to the axis of the polygonal shape and are of relatively small angular extent about that axis. The material of one or both of the skirt and container portion is resiliently elastic. The closure may be assembled with an axial push, and removed by twisting.

11 Claims, 7 Drawing Sheets

(51) Int. Cl.
*B65D 41/17* (2006.01)
*A61J 9/08* (2006.01)

(52) U.S. Cl.
CPC ..... *A61J 11/045* (2013.01); *B65D 41/17* (2013.01); *B65D 2251/065* (2013.01)

(58) Field of Classification Search
USPC ..... 215/11.6, 10
See application file for complete search history.

(56) References Cited

U.S. PATENT DOCUMENTS 3,432,059 A * 3/1969 Hurst ..... A61J 11/045 215/11.6
5,377,852 A * 1/1995 Demorest ..... A01K 9/00 119/72
5,401,200 A * 3/1995 Ellis ..... A63H 33/04 220/4.27
5,938,053 A * 8/1999 Verbovszky ..... A47G 19/2272 215/11.1
D463,568 S * 9/2002 Leung ..... D24/197
7,004,339 B2 * 2/2006 Renz ..... A61J 9/001 215/11.1
7,635,071 B1 12/2009 Montgomery et al.
7,731,050 B2 * 6/2010 Parks ..... B65D 21/0219 206/509
7,959,022 B2 * 6/2011 Kerman ..... B65D 41/0471 215/252
2010/0193459 A1 * 8/2010 Housley ..... A61J 9/008 215/6
2016/0250106 A1 * 9/2016 Rozenbaum ..... A61J 9/001 215/11.3

* cited by examiner

CLOSURE AND FEEDING BOTTLE INCORPORATING IT

CROSS-REFERENCE TO RELATED APPLICATIONS

This application is a 35 U.S.C. 371 National Phase Entry Application from PCT/SG2014/000133, filed Mar. 17, 2014, the disclosures of which are incorporated herein in their entirety by reference.

BACKGROUND

This invention relates to closures, in particular to manually-operated closures, conventionally in the form of a lid or cap, which may be used to keep the contents of a container from contamination or to prevent spillage, and which can be easily operated to close or open the container manually.

A very wide variety of closure types is known. One type which has achieved widespread commercial success for decades is the so-called "screw cap". The container is provided with a rim of generally cylindrical shape on the outside of which are one or more threads. The cap is provided with an internal thread with a series of projections which may engage with a thread, particularly with a number of short thread sections distributed evenly about the periphery of the rim. Screw cap bottles, canisters and jars are widely used for containing liquids and solid materials.

Desirable features of a closure are that it should be straightforward to operate, both when closing a container, using the closure and when removing it when access to the contents or filling the container with content is required. A common requirement in numerous practical applications is that the closure should act to seal the opening on to which it is screwed and this is conventionally achieved by way of a resilient liner or ring of resilient material which, when the closure is applied and screwed down, is urged to seal against the edge of the usually circular aperture on the container itself.

As well as screw closures, a wide variety of press-fit or snap-on lid closures are known. These are not applied by rotation, but rather the closure or lid has some form of formation on it, usually at or near its edge, which is shaped to engage a corresponding formation on the rim of the container itself. In order to secure a reasonably tight connection between the closure and the container, one or both are conventionally made of a resilient material, for example a resilient plastics material.

Hybrid closures are also known where closure may be effected for example by pressing a lid with a skirt of resilient material on to a neck ring at the top of a glass container, with formations on the interior of the skirt engaging underneath formations on the neck ring. By the provision of appropriate camming surfaces, the skirt may be caused to move outwards if the closure is twisted relative to the container itself in such a fashion that the inter-engagement between the skirt and the neck ring is removed and the closure can then be lifted off. Such "snap-to-fit" and "twist to remove" lids have been used on jars for foodstuffs, such as soluble coffee solids granules, for some time.

A further type of closure is a so-called bayonet closure. In such a closure, a cylindrical wall and a skirt on the cylindrical cap have a space between them and, on the inside of the skirt and the exterior of a ring on the container, there are two or more projecting members which can be inter-engaged one with another, the extent of projection generally being slightly less than the radial gap between the skirt on the lid and the ring on the container. One of the projecting members is a generally hook-shaped projection and the other a bead or the like which can engage in the hook-shaped projection.

Such closures conventionally rely on pressing the lid and container axially together, with compression of a compressible member between the lid and the ring on the container, and then twisting the lid on the container to bring the projections and hooks into alignment. Once the pressure on the lid is removed, the compressible member urges the bead to fit into the hook, so preventing the lid from coming off. To release the lid, it is simply pressed down and turned in the opposite direction to enable the projecting members to be freed from the hooks, whereafter the lid can simply be taken off. Examples of such bayonet cap closures are disclosed in GB 1383865 and GB 1282077.

SUMMARY

In accordance with the present invention, there is provided a closure consisting of a lid or cap member and a container member inter-engageable with one another to provide closure of the container, wherein the lid or cap member has a skirt and the container member has an upstanding rim, each of which is of generally polygonal shape, with three to six sides, and wherein located on each of the facing walls on each side of the polygonal shape are inter-engageable projections, where the inter-engaging surfaces of the projections run substantially in a plane perpendicular to the axis of the polygonal shape and are of relatively small angular extent about that axis, and wherein the material of one or both of the skirt and container portion is resiliently elastic.

The preferred general shape of the closure components is square or slightly rectangular or trapezoidal. The location of the inter-engaging portions is preferably offset from the centre of each side of the polygonal shape.

Preferably, in addition to the inter-engaging formations, the skirt and container member exterior have camming surfaces which can engage with one another when the lid or cap member is placed on the container member and which tend as the inter-engageable projections are brought into engagement to urge the lid or cap member to rotate relatively to the container member to achieve a maximum area of inter-engagement between those projections. Preferably the camming surfaces take the form of a bead on the exterior of the container portion and a recess with a sloping side on the interior wall of the skirt of a lid or cap member, both offset from the centre of each side of the polygonal shape.

Because of the resilience of one or both components, the closure can be assembled as a snap-fit closure by urging the lid or cap in the axial direction of the polygonal shape, i.e. simply pushing it on to the container portion. When it is desired to remove the lid or cap, it is twisted and, because of the polygonal shape, the inter-engaging portions move relative to one another both radially and circumferentially. The combined movement enables easy removal of the lid portion from the container.

Preferably the peripheral extent of the inter-engaging portions of the inter-engaging members is less than 8°, most preferably about 5°.

The two inter-engaging members on each of the sides may have angled or chamfered sections to assist quick application of the lid or cap when pushing in an axial direction. Portions of the preferably included camming sections may also be chamfered to assist centring when the cap or lid is applied.

Preferably the interior of the cap or lid includes a seal member adapted, when the cap or lid is applied, to seal the container opening.

While the closure construction in accordance with the present invention may be applied to a very wide variety of containers, it is of particular value when applied to feeding bottles for infants, where the lid or cap member may incorporate a teat and a subsidiary cap member to cover the teat when the bottle is not being used for feeding. The subsidiary cap member may simply be a press-fit, optionally with a slight bead to secure it in place over the teat.

Preferably the exterior of the skirt has a pair of relief textured areas, desirably at or near two opposed corners of the polygonal shape. These are naturally seen as the areas at which to grasp the skirt between thumb and fingers when wishing to remove the lid or cap member and the radial pressure from outside assists the distortion of the lid or cap member and accordingly its easy disengagement from the container.

The container itself may be of any convenient shape or material. If the material of the container is relatively rigid, then the material of the lid or cap may need to be correspondingly more elastic.

The preferred materials from which the lid or cap member and the portion of the container on to which it fits are made are resilient plastics materials, for example polypropylene, ABS copolymer, PET or polycarbonate. The preferred manufacturing method for both components is by injection-moulding since this allows precise configuration of the interlocking portions.

If in the case of use of the closure according to the present invention on baby feeding bottles, the overall shape of the feeding bottle is preferably polygonal, highly preferably square with rounded corners, and the container part of the bottle itself is axially tapered so that a set of them may be stacked to save space. A particularly preferred configuration for the container member is to provide two sections for the main body, a section of slightly larger size than the internal size of the opening at its top and a section of slightly smaller size which will fit into the top part of an identical container member, with the transition between the two sections being sloped and resting on the lip of the lower container member. A baby feeding bottle configured in this way to enable a set of such bottles (without their covers) to be stacked, is new. By suitable dimensioning, jamming of the stacked containers together can be avoided.

Such baby bottles may also be provided with two lids or caps, both of which will fit on the container portion, one of which is configured as indicated above to hold a teat while the other constitutes a plain lid, cap or cover enabling the feeding bottle portion to be used as a storage container. The lid, cap or cover may have a ring or groove in it sized to fit the base of the container portion, so enabling a stabler stack to be achieved.

The invention is illustrated by way of example with reference to the accompanying drawings which show a baby feeding bottle constructed in accordance with the invention.

DETAILED DESCRIPTION

Figure 1:
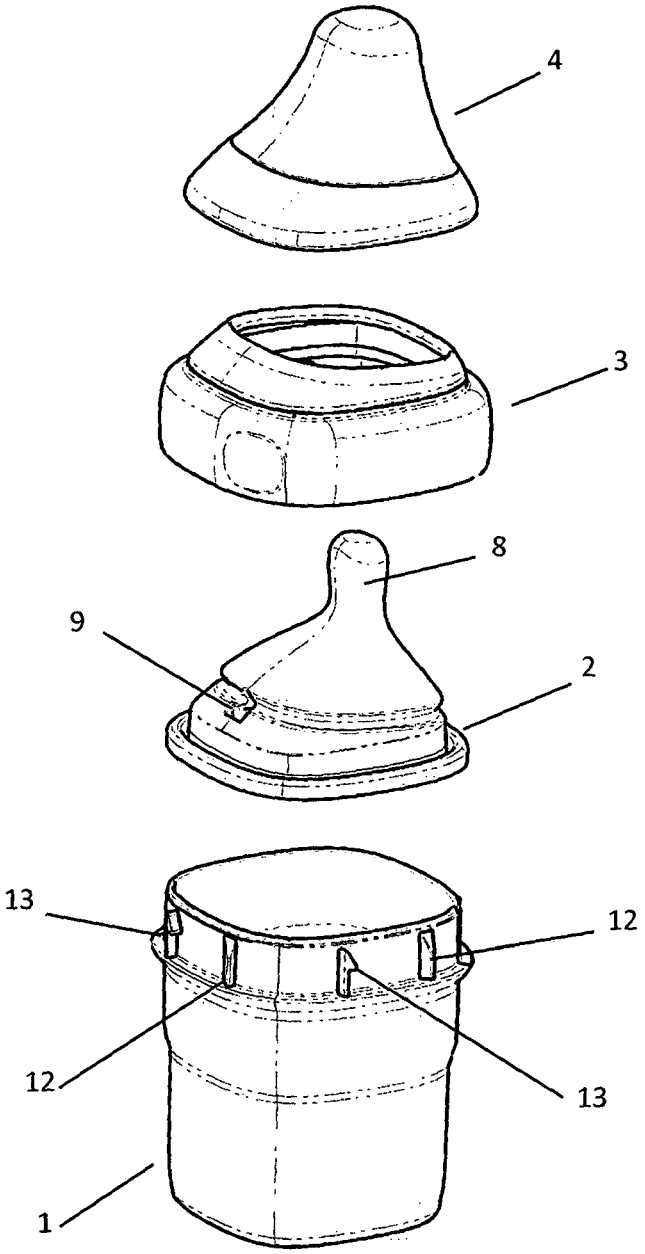
FIG. 1 is an exploded view of a feeding bottle incorporating a closure according to the invention.
Figure 2:
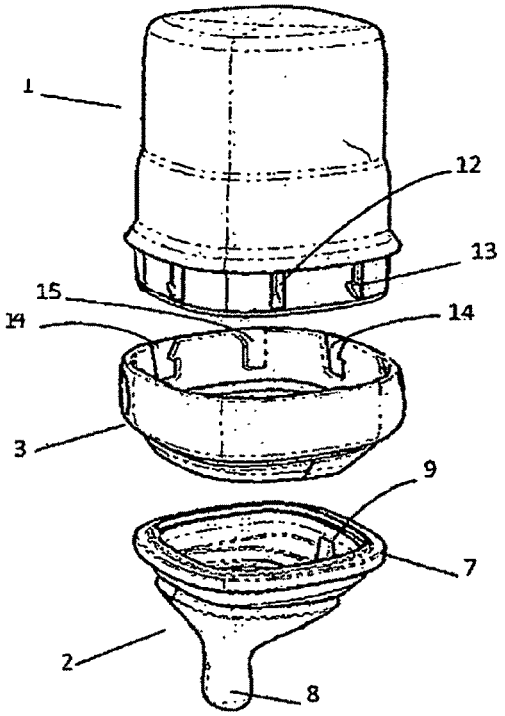
FIG. 2 is an exploded view of the feeding bottle of FIG. 1 without the protective cap upside down.
Figure 3A:
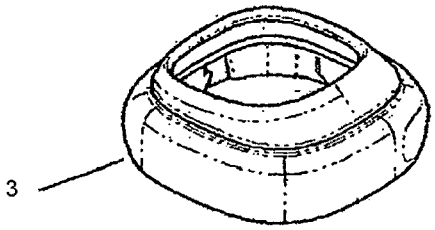
FIGS. 3A and 3B shows perspective views of the closure member from above and below.
Figure 3B:
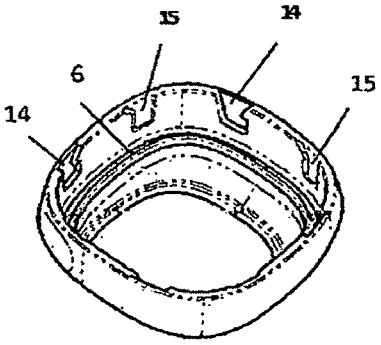
Figure 4:
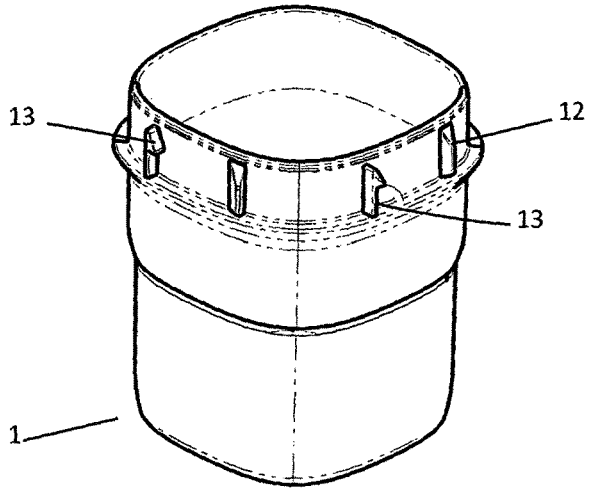
FIGS. 4, 5 and 6 are respectively perspective top and side views of the container portion of the feeding bottle shown in FIG. 1.
Figure 5:
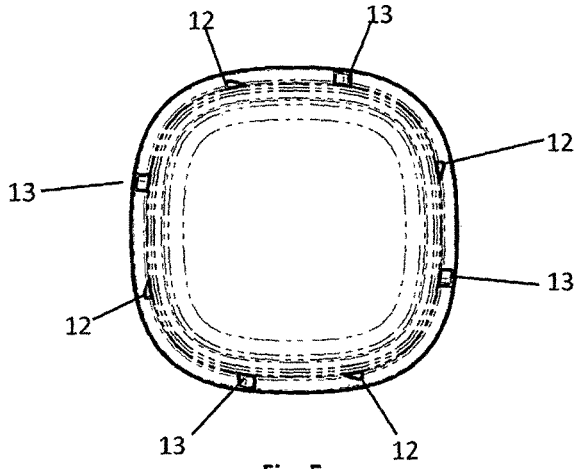
Figure 6:
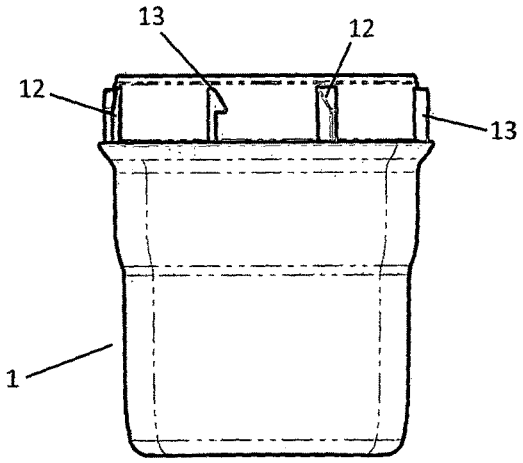

Referring to the drawings, the baby feeding bottle consists of a cup-like container 1, a teat 2, a snap-fit closure ring 3 and a teat protector cover 4.

The teat protector 4 is a press-fit on to the exterior part of closure ring 3. The closure ring has a peripheral groove 6 in it shaped and dimensioned to receive in a snug fit a rim 7 formed on the teat 2.

The teat 2 is of generally known construction with an offset nipple 8 and an air inlet valve 9.

Moulded into the upper rim of the container 1 are four wedge-shaped cam members 2 and four latching members 13.

Moulded on the inside of closure ring 3 are corresponding recesses 15 and 14 respectively into which cam member 2 and latching member 13 may fit. As can be seen, each recess 14 has a short land in a plane perpendicular to the axis of the closure ring.

Figure 9:
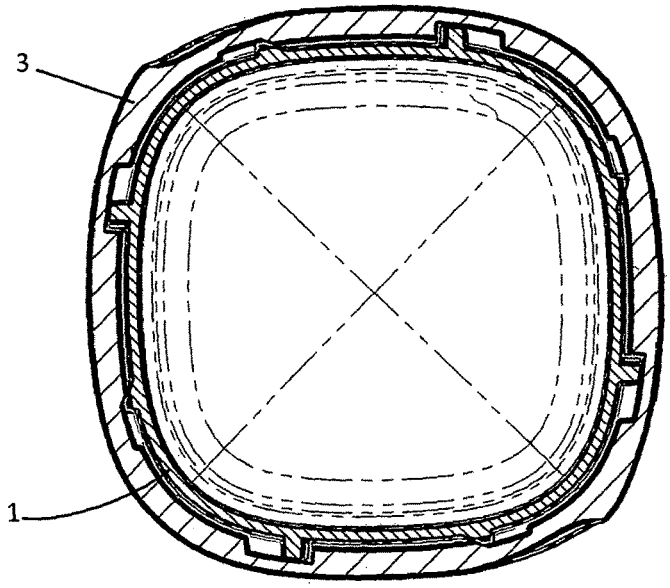
FIG. 9 is a section through the assembled bottle at the level of the closure.
Figure 10:
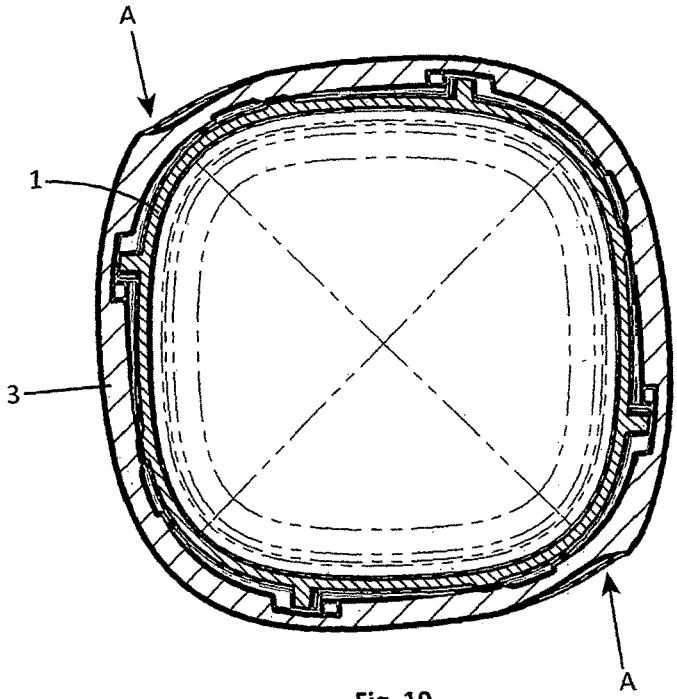
FIG. 10 is a section similar to FIG. 9 but showing the relative position of the components when it is desired to remove the lid portion from the bottle portion.
Figure 11:
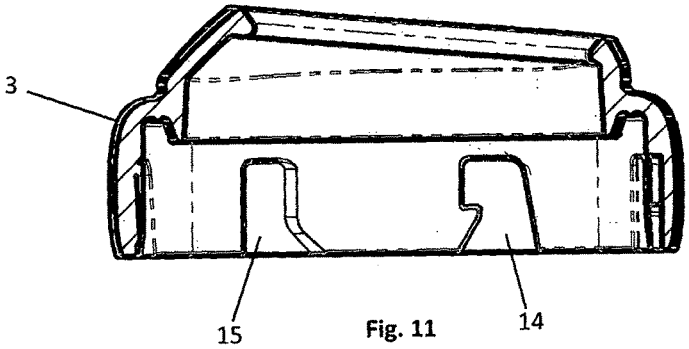
FIG. 11 is a section through the lid portion of the bottle.
Figure 12:
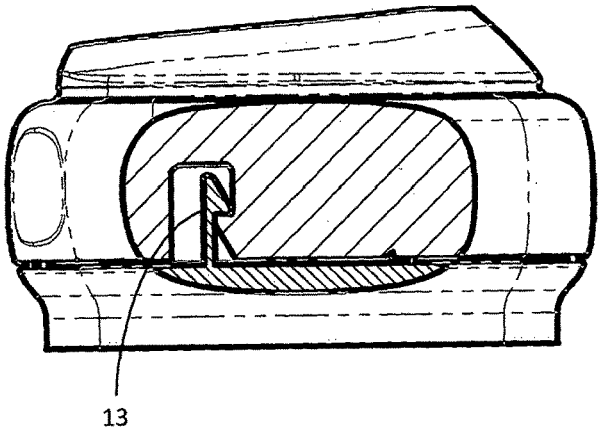
FIG. 12 is a detailed view of the inter-engaging parts of the closure from one side.
Figure 13:
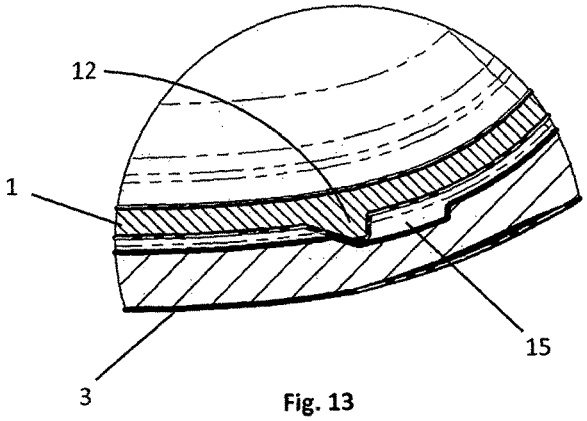
FIG. 13 is a horizontal sectional view showing the detail of certain of the features of the top of the bottle and the interior of the skirt forming part of the closure.
Figure 14:
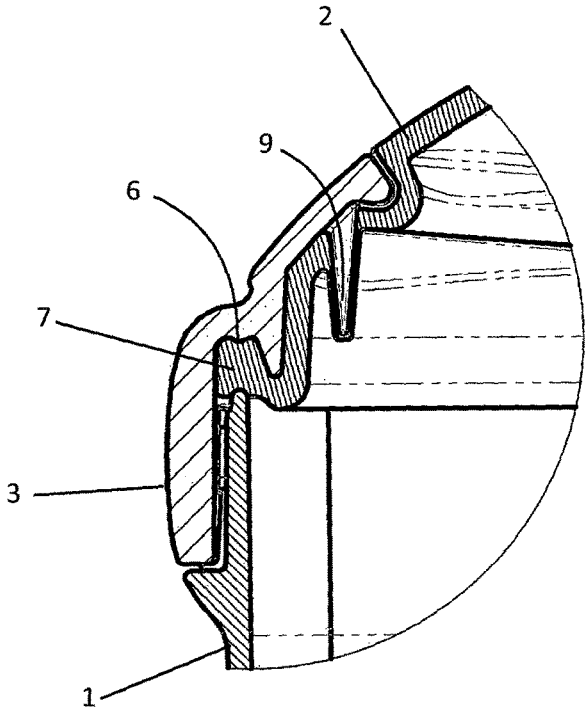
FIG. 14 is a partial axial section showing the detail of the engagement between bottle and closure including the teat compressed between them.

FIGS. 9 and 10 show the relative positions of the container section 1 and the closure ring 3 in normal use (FIG. 9) and when the closure ring is twisted in order to open the container so that its components may then be washed and sterilised for re-use. The resilience of the rim of the teat 2, which is normally made of relatively compressible flexible rubbery material, such as a silicone rubber, enables the parts to twist relative to one another and at the same time, as shown in FIG. 10, the inter-engaging portions of latching member 13 and recess 4 are moved relative to one another. The relative movement has both circumferential components and radial components, the latter being due to the flexing of the ring by the application of pressure to two opposite corners, the pressure points being indicated by the two arrows A in FIG. 10. There is a gentle dent in each corner to guide the user.

As soon as the respective horizontal inter-engaging portions of latching member 13 and the corresponding recess 14 have moved sufficiently far, the closure ring 3 detaches from the bottle base 1.

The dimensions of the components are designed so that the angular rotation of the closure ring 3 relative to the bottle base 1 is about 6°.

It should be noted that the closure may be easily and securely effected simply by pushing the closure ring 3 axially towards the container section 1. The generally rectangular shape means that the user automatically aligns the two and, because of the chamfered entry points to the recesses in closure ring 3, final positioning of the ring 3 on the container portion 1 is achieved by interaction between the latch member 13 and cam member 12 on the one hand and the recesses 14 and 15 respectively on the other.

It is the flexing of the closure ring wall perpendicular to its plane caused by cam member 12 being driven into the face of the wall when the closure is undone and the offset (from the centre of the closure and container) of the force that results from the elastic wall trying to revert to its original shape that creates the restoring/closing torque. There is an additional cam wedging action which occurs when the two parts are close to being in final alignment. This flexing of the wall allows a more gentle, controllable restoring torque over the full 5-8° travel than a conventional final wedging 'bump-indent' action that aligns the two parts at the end of their travel; a little wedging 'bump-indent' action is, however, needed because the wall flex torque tends to zero as the two parts come into alignment. The degree to which the relative strength of these forces interact will depend on the particular contouring of the cam members, latching members and recesses, which can be achieved by careful design and accurate moulding of the top of the container section and the skirt of the closure ring.

Designing a baby feeding bottle as shown in the accompanying drawings gives rise to a number of advantages compared with many existing feeding bottles. First, because it is closed using a snap assembly, it is easy to do with one hand, for example by a parent holding a thirsty, and possibly fractious, baby. Secondly, the generally rectangular shape means that it is extremely easy to grip the bottle when twisting the closure ring off it. The forces involved for opening the bottle are rather different, as explained herein, from those which arise when the part are snap-fitted together, which gives rise to the advantage that the bottle will not come apart when dropped or thrown on to the floor full of milk by a recalcitrant infant. Although the parts are assembled with an axial push, they have to be separated with a relative twist—impact forces such as arise if the full bottle is dropped do not tend to create a relative twist between the two parts.

A further advantage is that the container for the milk may be configured to have a wide mouth with no undercuts; this materially increases the ease and effect of cleaning the bottle components after use.

Although the bottle illustrated is shown with a teat 2, this can be replaced as the child becomes older with a feeding spout of known form.

Figure 8:
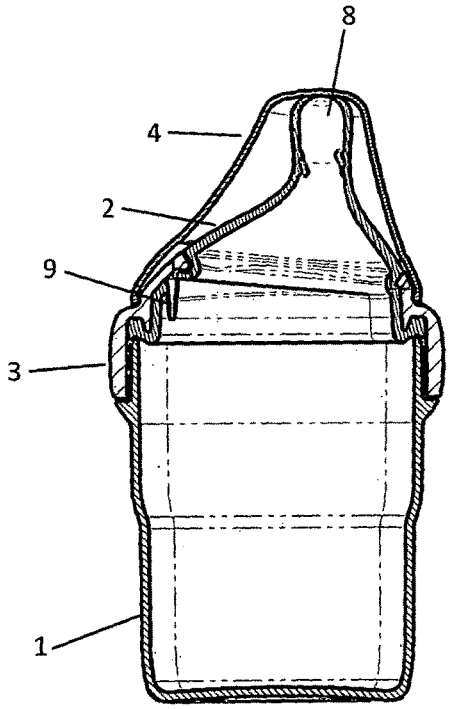
FIG. 8 is a vertical section through the assembled bottle.

Although the teat 2 and closure ring 3 are shown as separate components in the specific embodiment illustrated, with the zig-zag section of the teat as shown most clearly in FIG. 8 being shaped to ensure that there is a good fit and a good seal, it is possible to conceive of a combined teat and closure ring where one is moulded on to the other.

Figure 7:
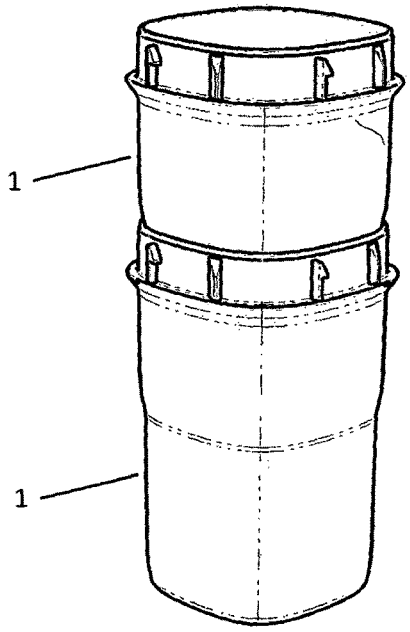
FIG. 7 shows how two such portions may be stacked.

The bottle may be provided with a second closure ring which, instead of having an aperture for a teat, simply constitutes a plain cover which forms a lid enabling the bottle portion to be used for storing liquids or solids. When not used for storage, the tapered shape of the bottle enables a plurality of such bottle containers to be stacked as shown in FIG. 7. As can be seen in the Figures, the exterior of the container portion has an upper section of size slightly larger than its lower section, with a transition about half-way up the container portion. The container portion is dimensioned so that the lower part of one fits easily, i.e. without jamming, into the upper part of a like container portion, with the transition in the wall of the upper container portion resting on the upper rim of the lower container portion.

The invention claimed is:

1. A closure consisting of a lid or cap member and a container member inter-engageable with one another to provide closure of the container member, wherein the lid or cap member has a skirt and the container member has an upstanding rim, each of which is of generally polygonal shape, with three to six sides, and wherein located on each of the facing walls on each side of the polygonal shape are inter-engageable projections, where the inter-engaging surfaces of the projections run substantially in a plane perpendicular to the axis of the polygonal shape and are of relatively small angular extent about that axis, wherein the material of one or both of the skirt and container portion is resiliently elastic, and wherein the location of the inter-engageable projections is offset from the centre of each side of the polygonal shape.

2. A closure according to claim 1, wherein the general shape of the lid or cap member or container member is square.

3. A closure according to claim 1, wherein two inter engageable projections on each of the sides may have angled or chamfered sections to assist quick application of the lid or cap when pushing in an axial direction.

4. A closure according to claim 1, wherein the interior of the cap or lid includes a seal member adapted, when the cap or lid is applied, to seal the container opening.

5. A feeding bottle for infants incorporating a closure according to claim 1, and wherein the lid or cap member incorporate a teat and a subsidiary cap member to cover the teat when the bottle is not being used for feeding.

6. A feeding bottle for infants according to claim 5, wherein the container member of the bottle are in the form of stackable open-topped containers.

7. A feeding bottle for infants according to claim 5, wherein the wall of the container member has two sections between which is a transition section between a narrower lower section and a wide upper section, the transition section matching the shape and size of the upper rim of the container section.

8. A feeding bottle, comprising:

a container having the closure according to claim 1, further comprising two lids, both of which will fit on the container member of the closure, one of which is configured to hold a teat while the other constitutes a plain lid cap or cover enabling the container to be used as a storage container.

9. A closure consisting of a lid or cap member and a container member inter-engageable with one another to provide closure of the container member, wherein the lid or cap member has a skirt and the container member has an upstanding rim, each of which is of generally polygonal shape, with three to six sides, and wherein located on each of the facing walls on each side of the polygonal shape are inter-engageable projections, where the inter-engaging surfaces of the projections run substantially in a plane perpendicular to the axis of the polygonal shape and are of relatively small angular extent about that axis, wherein the material of one or both of the skirt and container portion is resiliently elastic, wherein the skirt and container portion exterior have camming surfaces which can engage with one another when the lid or cap member is placed on the container member and which tend, as the inter-engageable projections are brought into engagement, to urge the lid or cap member to rotate relatively to the container member to achieve a maximum area of inter-engagement between those projections, and wherein the camming surfaces take the form of a bead on the exterior of the container member and a recess with a sloping side on the interior wall of the skirt of a lid or cap member, both offset from the centre of each side of the polygonal shape.

10. A closure consisting of a lid or cap member and a container member inter-engageable with one another to provide closure of the container member, wherein the lid or cap member has a skirt and the container member has an upstanding rim, each of which is of generally polygonal shape, with three to six sides, and wherein located on each of the facing walls on each side of the polygonal shape are inter-engageable projections, where the inter-engaging surfaces of the projections run substantially in a plane perpendicular to the axis of the polygonal shape and are of relatively small angular extent about that axis, wherein the material of one or both of the skirt and container portion is resiliently elastic, and wherein the peripheral extent of the inter-engageable projections is less than 8°.

11. A closure consisting of a lid or cap member and a container member inter-engageable with one another to provide closure of the container member, wherein the lid or cap member has a skirt and the container member has an upstanding rim, each of which is of generally polygonal shape, with three to six sides, and wherein located on each of the facing walls on each side of the polygonal shape are inter-engageable projections, where the inter-engaging surfaces of the projections run substantially in a plane perpendicular to the axis of the polygonal shape and are of relatively small angular extent about that axis, wherein the material of one or both of the skirt and container portion is resiliently elastic, and wherein the exterior of the skirt has a pair of relief textured areas, at or near two opposed corners of the polygonal shape.

* * * * *